United States Patent [19]

Belokin, Jr.

[11] Patent Number: 4,618,115

[45] Date of Patent: Oct. 21, 1986

[54] DISPLAY DEVICE MODULE WITH MULTIPLE SHELVES

[76] Inventor: Paul Belokin, Jr., P.O. Box 1907, Denton, Tex. 76201

[21] Appl. No.: 656,362

[22] Filed: Oct. 1, 1984

[51] Int. Cl.[4] ..... A45D 19/04

[52] U.S. Cl. ..... 248/174; 211/135

[58] Field of Search ..... 248/174, 170, 152; 211/133, 135, 149; 108/53.1, 111, 91, 112; 206/44 R, 511, 512, 45.25, 45.27, 45.26; 312/108, 259; 229/16 D

[56] References Cited

U.S. PATENT DOCUMENTS

| | | | |
|---|---|---|---|
| 1,124,175 | 1/1915 | Sackett | 248/174 X |
| 1,916,471 | 7/1933 | Fallert | 248/174 |
| 2,043,483 | 6/1936 | Lynch | 248/174 |
| 2,132,785 | 10/1938 | Hill | 108/111 |
| 2,486,745 | 11/1949 | Harris | 312/259 X |
| 3,313,585 | 4/1967 | Berger et al. | 312/259 |
| 3,834,324 | 9/1974 | Lang | 108/111 X |
| 3,877,396 | 4/1975 | Patterson | 108/111 |
| 4,234,148 | 11/1980 | Maddestra | 248/174 |
| 4,308,948 | 1/1982 | Provost | 206/45.25 |
| 4,428,487 | 1/1984 | Hepp | 108/111 X |

*Primary Examiner*—J. Franklin Foss

*Attorney, Agent, or Firm*—Wood, Dalton, Phillips, Mason & Rowe

[57] ABSTRACT

According to the invention, a collapsible display module has a wall blank with wall panels connected end to end foldably relative to each other to define a continuous wall structure. The wall blank is convertible between a flattened state wherein it can be readily stored and transported, and an expanded display state wherein pairs of opposed, facing panels bound a storage space. First and second flaps associated with each of the wall panels of one wall panel pair interconnect and define spaced shelves for placement of articles to be displayed.

12 Claims, 13 Drawing Figures

FIG. 4
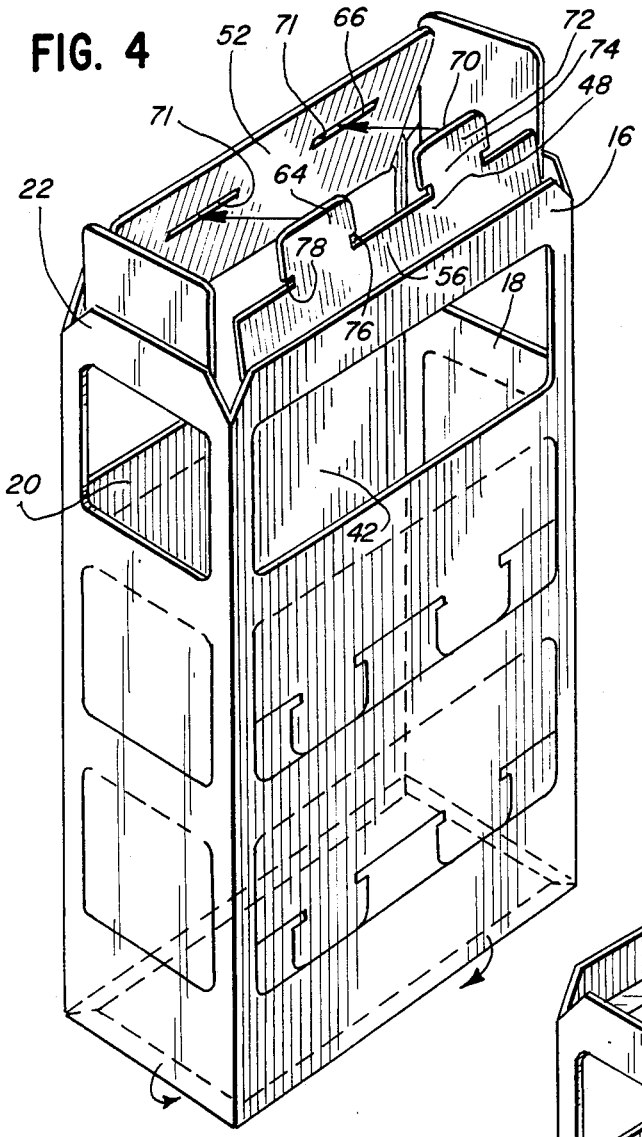
FIG. 5
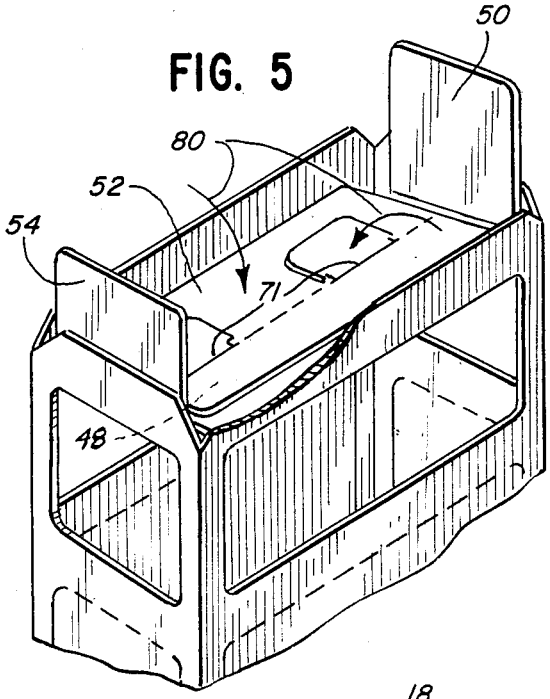
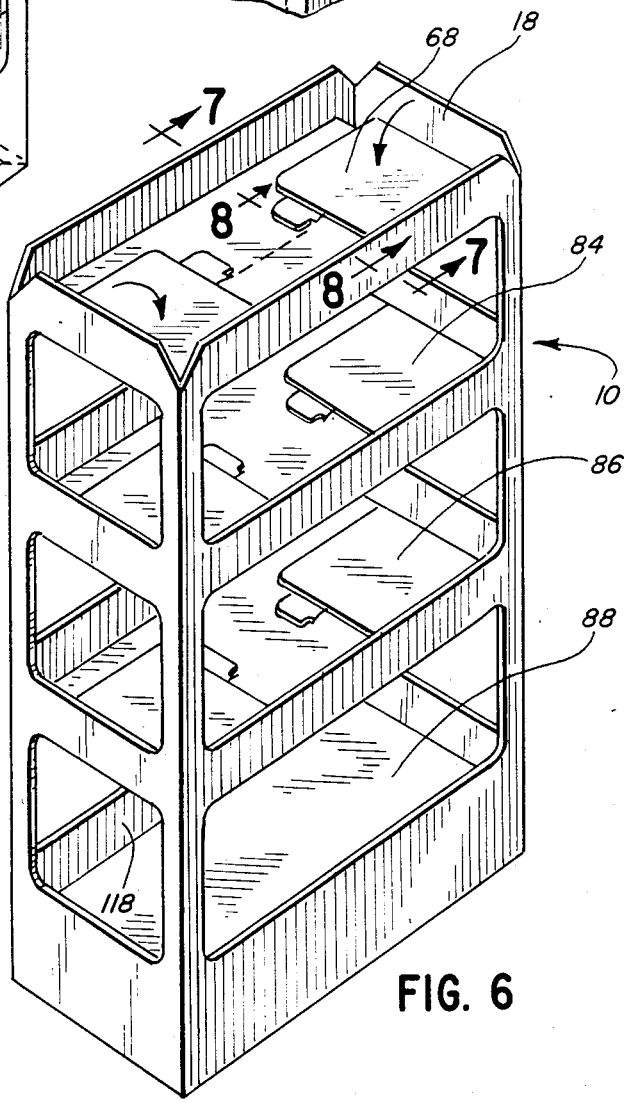
FIG. 6
FIG. 7
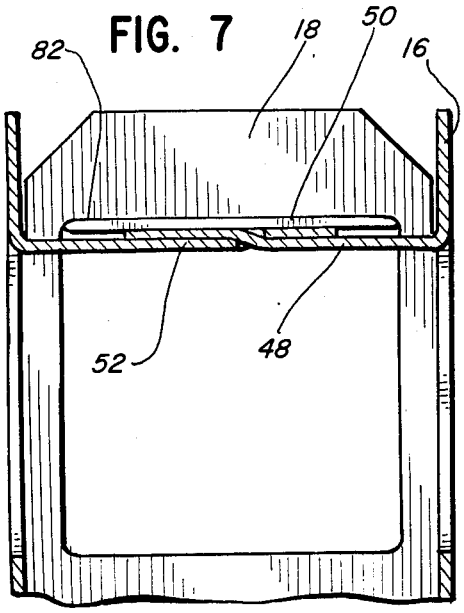

DISPLAY DEVICE MODULE WITH MULTIPLE SHELVES

BACKGROUND OF THE INVENTION

1. Field of the Invention

This invention relates to prefabricated display stands for exhibiting merchandise and, more particularly, to a display stand with folding modules that can be erected to derive a desired display configuration.

2. Background Art

Prefabricated display stands are commonly used for displaying merchandise in retail establishments, particularly supermarkets. It is known to make stands from cardboard of similar material that is compatible with low cost and lightweight construction.

An exemplary structure is shown in U.S. Pat. No. 3,372,813, to Ishida. In Ishida, separate corner columns and shelves are provided and are suitably joined together as by staples, to derive a desired display stand configuration, dictated by the quantity and size of articles to be exhibited. Construction of the display stand is complicated by the several parts and fasteners required to assembly the parts. Further, the resulting display stand is semipermanent in nature and knock-down for reuse of the parts not contemplated. Rather, disposal is taught by Ishida after use, specifically by burning.

It is known to construct stands in modular fashion. For example, in U.S. Pat. No. 2,684,766, to Blom, stackable trays are disclosed which are nested within one another for increased storage. While the Blom structure is not intended as a display device, the problems contended with in the stacking are also present in the display stand art. Most prevalent of these problems is that of structural instability. As the height of the overall stand increases, the tendency of the stand to collapse increases due to the absence of any framework or reinforcing structure. This is particularly a problem where goods are displayed on elevated shelves. Often, as goods are drawn from those shelves, there is a tendency to pull the upper modules off the underlying module(s).

The present invention is specifically directed to overcoming the above enumerated problems in a novel and simple matter.

SUMMARY OF THE INVENTION

According to the invention, a collapsible display module has a wall blank with wall panels connected end to end foldably relative to each other to define a continuous wall structure. The wall blank is convertible between a flattened state wherein it can be readily stored and transported, and an expanded display state wherein pairs of opposed, facing panels bound a storage space. First and second flaps associated with each of the wall panels of one wall panel pair interconnect and define spaced shelves for placement of articles to be displayed.

It is the principal object of the invention to provide a display module that can be readily converted from a flattened, storage and shipment state to a display configuration with multiple shelves without the use of staples or other type of fastener. The interconnecting flaps prevent relative shifting of the panels with the module in its display state. The module is only minimally distorted so that it can be collapsed and reused without weakening the resulting stand.

It is another object of the invention to provide display modules that are readily stackable, one atop the other, to produce desired display capacity. At the same time, the modules cooperate with one another in stacked relationship to maintain each of the modules in a display state.

In accomplishing this end, a separate pair of locking flaps is provided and bears on the interconnected flaps associated with the one panel pair. In effecting stacking, each of the modules is engaged telescopingly with an adjacent module and the bottom edge of an overlying module exerts a force on the locking flaps to maintain the bearing relationship of the locking flaps and keep the underlying module intact.

The invention also contemplates constructing the module from a lightweight material so that the overall display, in spite of its potential size, is light in weight and firmly founded by reason of the aforementioned modular construction. The flap pairs can be struck directly from the blank and folded out therefrom to provide viewing openings for the displayed articles in the storage space. Little material waste results.

It is still a further object of the invention to provide structure for reinforcing stacked modules. This structure preferably takes the form of a pillar and extends through aligned apertures in the shelves of the stacked modules. The pillar rigidifies each of the individual modules and prevents separation of modules other than through opposite, relative vertical shifting thereof. This lessens the likelihood of inadvertent separation of modules as upon withdrawing articles laterally from the display space.

Other objects and advantages of the invention will become apparent upon reviewing the following detailed description taken in conjunction with the drawings and appended claims.

BRIEF DESCRIPTION OF THE DRAWINGS

FIG. 4 is a perspective view of the display module demonstrating the first step in transforming the folded module to its display state with opposed flap pairs folded upward relative to their associated panel;

FIG. 5 is a fragmentary perspective view of the module with one of the flap pairs interconnected;

FIG. 6 is a perspective view of the display module in its display state with the other flap pair folded down against the interconnected flaps;

FIG. 7 is a fragmentary sectional view of the display module along line 7—7 of FIG. 6;

DETAILED DESCRIPTION OF THE DRAWINGS

Figure 1:
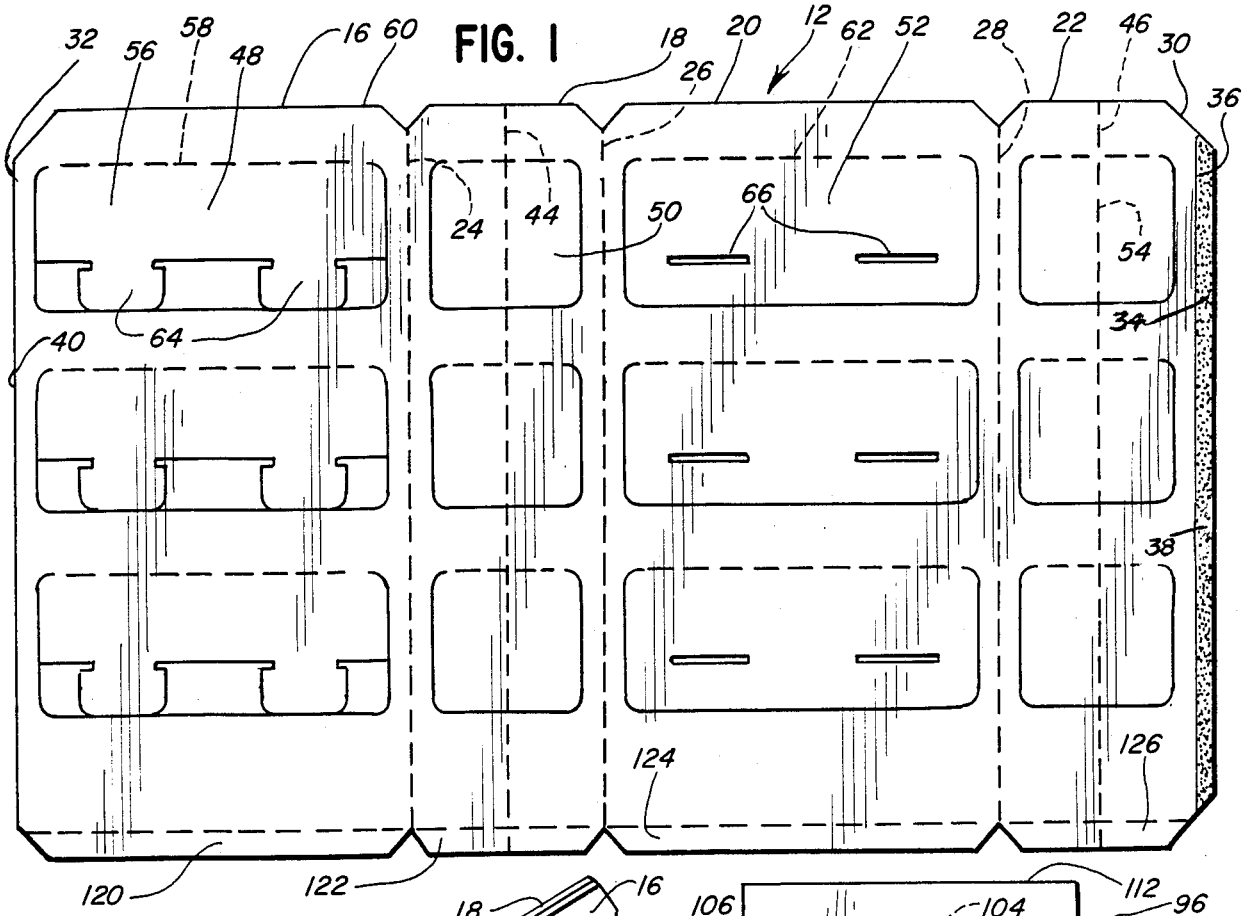
FIG. 1 is an elevation view of a blank used to form a display module according to the present invention.

A blank used to construct a display module at 10 in FIG. 6 is shown in FIG. 1 at 12. Preferably, the blank is made from cardboard stock with a moisture resistant coating having sufficient rigidity to maintain its shape yet remain light in weight. The blank 12 comprises a series of wall panels 16, 18, 20, 22 connected end to end foldably relative to each other about lines 24, 26, 28 that may be perforated, scored or otherwise weakened so that folding of the panels relative to each other occurs in a predetermined fashion.

To provide a continuous wall structure, the free ends 30, 32 of the blank 12 are joined. The end 30 has an integral flap 34 which is bendable about a fold line 36 relative to the panel 22. An adhesive of a type known to those skilled in the art, is used to facially mate the surface 38 on the flap 34 with the flat surface 40 of the adjacent panel 16.

With the ends 30, 32 joined, the blank can be adjusted about the fold lines 24, 26, 28 to situate the panel pairs 16, 20 and 18, 22 in opposed, parallel relationship, as depicted in FIGS. 4 and 6. While each of the panels 16, 20 has a greater horizontal dimension than the pair 18, 22, this is only a matter of choice in design. The precise relative dimensions of the panels can be chosen depending on the desired display space 42 to be enclosed thereby.

Figure 3:
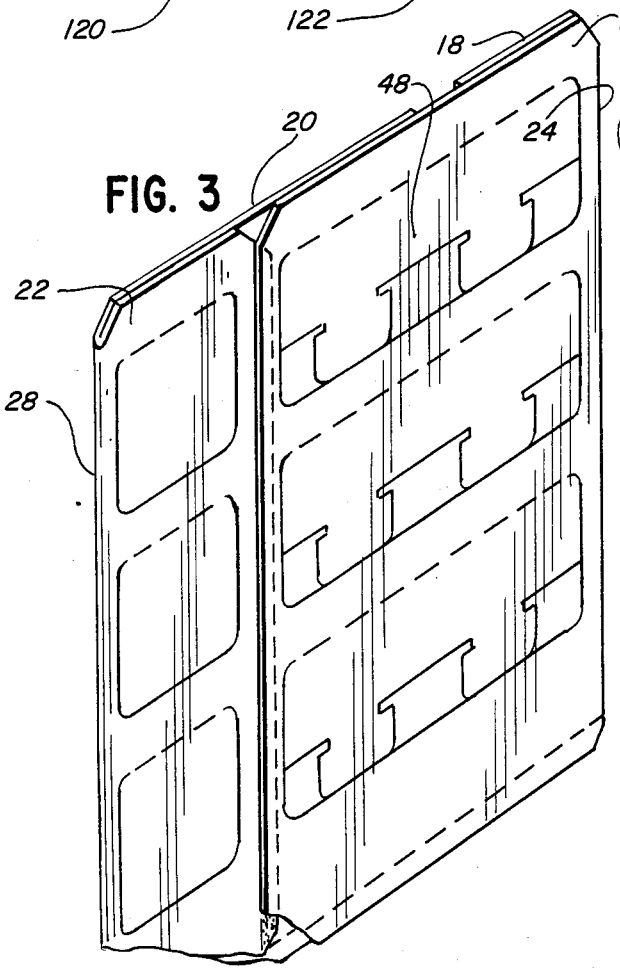
FIG. 3 is a perspective view of the display module of FIG. 1 in a folded state.

Another consideration in choosing the dimensions of the panels is the overall module dimension in its folded state shown in FIG. 3. This configuration is realized by folding the module about lines 24, 28 so that the wall panels 16, 22 facially abut the panels 18, 20. The overall horizontal dimension of the folded module is approximately equal to the combined horizontal dimensions of one of the narrower and wider panels. Alternatively, additional fold lines 44, 46 can be provided on panels 18 and 22 respectively. The inclusion of the fold lines 44, 46 allows for accordian type folding inwardly of the module between panels 16, 20 so that the overall horizontal dimension of the folded module is reduced by the width of the narrower panels 18, 22 from the folded module of FIG. 3.

Figure 8:
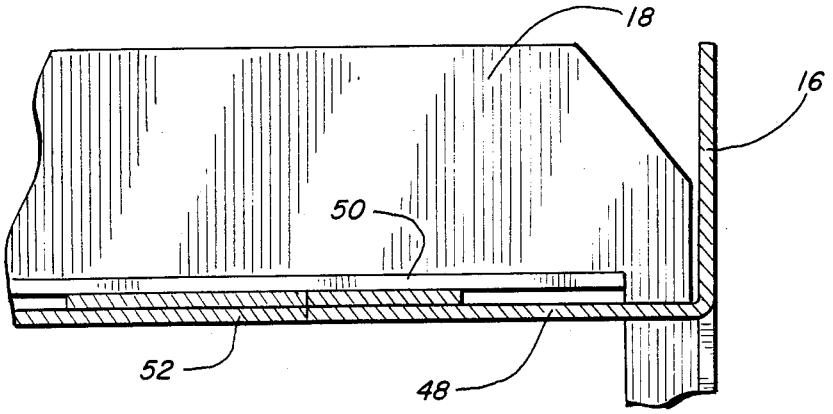
FIG. 8 is an enlarged, fragmentary sectional view of the module along line 8—8 of FIG. 6.
Figure 9:
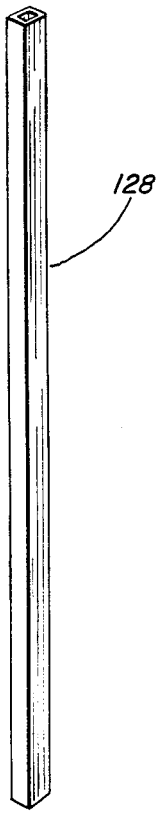
FIG. 9 is a perspective view of a pillar used to reinforce individual modules and interconnect adjacent, stacked modules.
Figure 10:
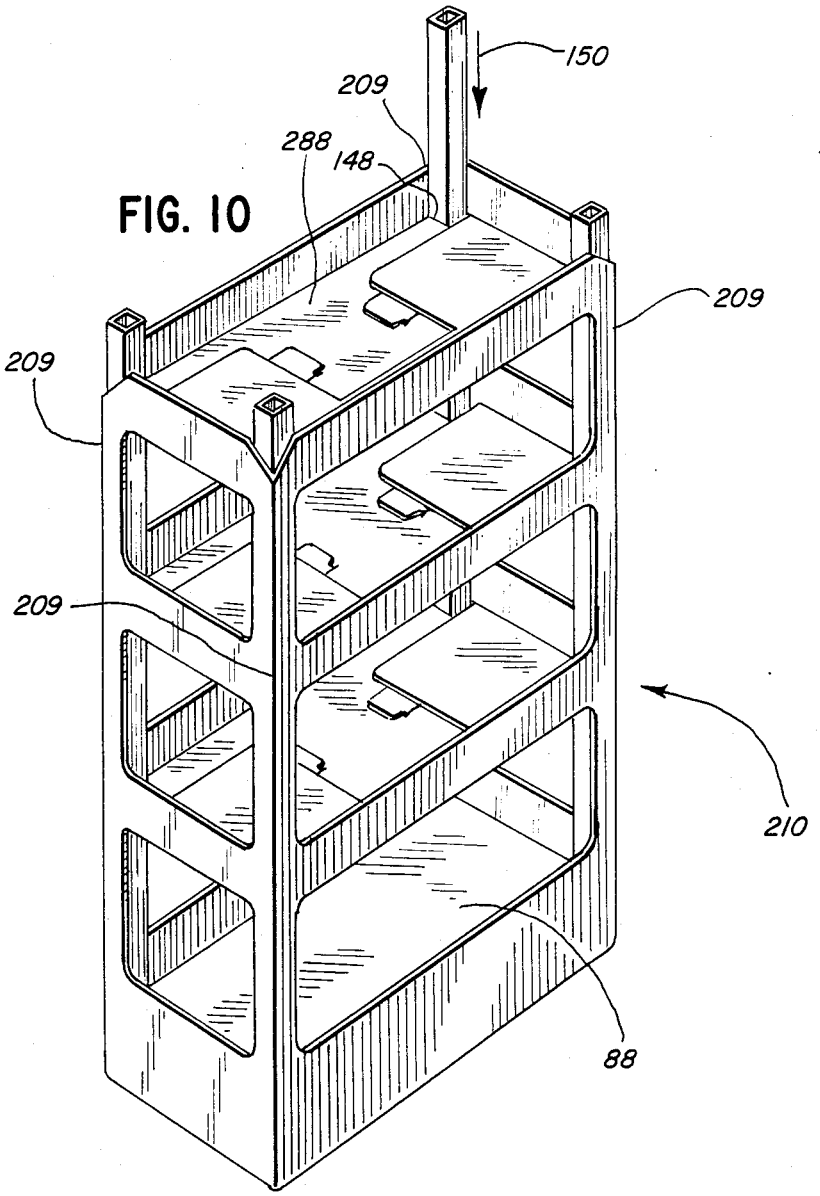
FIG. 10 is a perspective view of a modified form of module according to the present invention in its display state with pillars in place at the corners.

The steps in converting the module from its folded state in FIG. 3 to its display state in FIGS. 6–8 are shown sequentially in FIGS. 4–6. Initially, as shown in FIG. 4, the panels are folded relative to each other so that the corners at the junctures of the panels are square. To maintain the squared relationship between the panels, flaps 48, 50, 52 and 54 are provided, struck directly from the blank and remain integral with the walls of panels 16, 18, 20, and 22 respectively. Folding of the flaps out of the plane of the panels creates viewing openings in the panels.

Flaps 48 and 52 are shaped to interconnect with each other. The flap 48 comprises a body 56 integrally, foldably associated with the panel 16 along line 58. The fold line 58 is spaced beneath the upper edge 60 of the module for reasons that will become apparent subsequently. The flap 52 is integrally, foldably attached along line 62 to its associated panel 20. Fold line 62 is colinear with line 58. To interlock the flaps 48, 52, tabs 64 are provided on the body 56 and rectangular slots 66 in the flap 52 for reception of the tabs.

Conversion of the blank to its display state will be described with respect to one exemplary combination of flaps 48, 50, 52, 54. Each cooperating set of flaps defines a shelf 68 as shown at the upper region of the display in FIG. 6. While three such shelves are shown in the figures, any number may be chosen depending upon how the storage space is to be divided and the needs of the user.

With the wall structure squared, all flaps 48, 50, 52, 54 on the shelf 68 are folded upwardly relative to their respective panels. Flap pair 48, 52 is first interlocked by folding the flaps towards each other to extend the tabs 64 into the slots 66. To facilitate this extension, the leading edge 70 of each tab 64 is rounded so that the tabs 64 are self-aligning and guide themselves into their respective slots as the flaps 48, 52 are folded towards each other. Each tab comprises an enlarged head 72 and narrow neck 74 which connects the head 72 and body 56. The narrowed necks define spaced shoulders 76, 78 at the head 72 of each tab 64 facing away from the free edge of the tabs.

As the flaps realize a horizontal orientation, each tab 64 bends out of the plane of the body 56. The shoulders 76, 78 intersect the plane of flap 50 so that the shoulders 76, 78 interfere with a facing free edge 71 about each slot 66 in the event the wall panels 16, 20 are urged away from each other.

The tabs may be arranged on the body 56 slightly offset from the center of the slots. Slight shifting of the wall structure aligns the tabs and slots and permits extension of the tabs therein. With the tabs fully seated, the wall structure can be readjusted to its squared configuration. Once squared, one or the other of the shoulders 76, 78 on each tab misaligns with the slot and interferes with the flap 52 to prevent withdrawal of the tabs from the slots.

With the flaps 48, 52 interlocked, the flaps 50, 54 are folded in the directions of arrows 80 into facial overlying relationship with the interlocked flaps 48, 52. The relationship of the flaps 50, 54 is shown clearly in FIG. 7. The flaps 50, 54, serve a dual function. By bearing upon the interlocked flaps 48, 52, the tabs 64 are kept parallel to the flap body 56 to present the shoulders 76, 78 at the slot edges 71. Further, the flaps 50, 54 distribute weight of articles placed on the shelf 68. This reduces stress on the shelf 68 and the tendency of the flaps 48, 52 to deform as might weaken them for reuse or cause their separation to occur.

Figure 2:
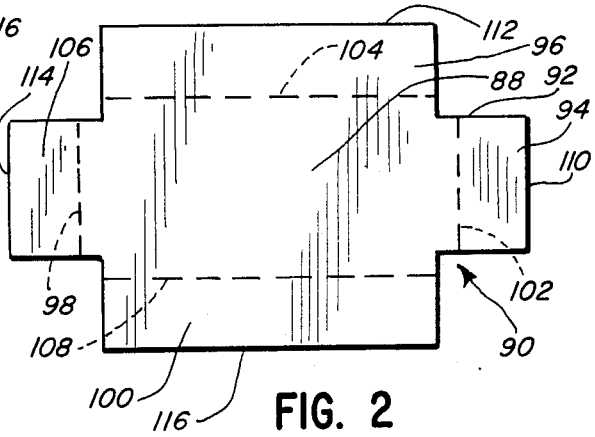
FIG. 2 is a plan view of a blank used to define a separate, bottom shelf for the module of FIG. 1.

Two additional shelves 84, 86 beneath the shelf 68 are formed in like manner. A further bottom shelf 88 is constructed separately from the module from a blank shown in FIG. 2 at 90. The blank 90 is substantially rectangular. Square cutouts 92 are made at each corner to separate flaps 94, 96, 98, 100. The flaps 94, 96, 98, 100 are foldable about lines 102, 104, 106, 108 respectively, which lines are scored, perforated or otherwise weakened to cause folding of the flaps 94, 96, 98, 100 in a predetermined manner. Each of the flaps is folded downwardly about its respective fold line. The bottom free edges 110, 112, 114, 116 of the flaps 102, 104, 106, 108 reside in a single plane and bear on the support surface for the module. The shelf height, as dictated by the dimensions of the flaps 94, 96, 98, 100, is chosen so that a peripheral, upstanding rim 118 is provided about the shelf 88. To enlarge the bearing surface on the bottom of the display module, flaps 120, 122, 124, 126 are turned under towards the center of the display.

A modified form of the invention is illustrated in FIGS. 9—13. The modification from the first embodiment is the provision of a pillar 128 at each of the corners 209 of the module 210. The pillars rigidify the structure in the event a single module is employed and facilitate vertical stacking of modules.

The pillars 128 preferably are square in cross section and are formed from a rectangular sheet of cardboard. The sheet has four lengthwise fold lines 130, 132, 134, 136 at equal intervals widthwise of the sheet. An exemplary sheet sidth may be on the order of ten inches. Five flat strips result with two inch wide faces 138, 140, 142, 144 and 146 with the sheet folded at right angles at the lines 130, 132, 134, 136. Face 138 is doubled back against face 146 and adhesively secured thereto.

To accommodate the pillars 128, square apertures 148 are provided at each corner of the shelves 280, 284, 286, 288 for close reception of the pillars. The four apertures on the upper shelf are aligned vertically with the apertures in the underlying shelves. To assemble the pillars, the pillars are advanced downwardly through the apertures as indicated by the arrow 150 in FIG. 10. Provision is also made in the shelf 88 at the corners thereof for the pillars.

Figure 11:
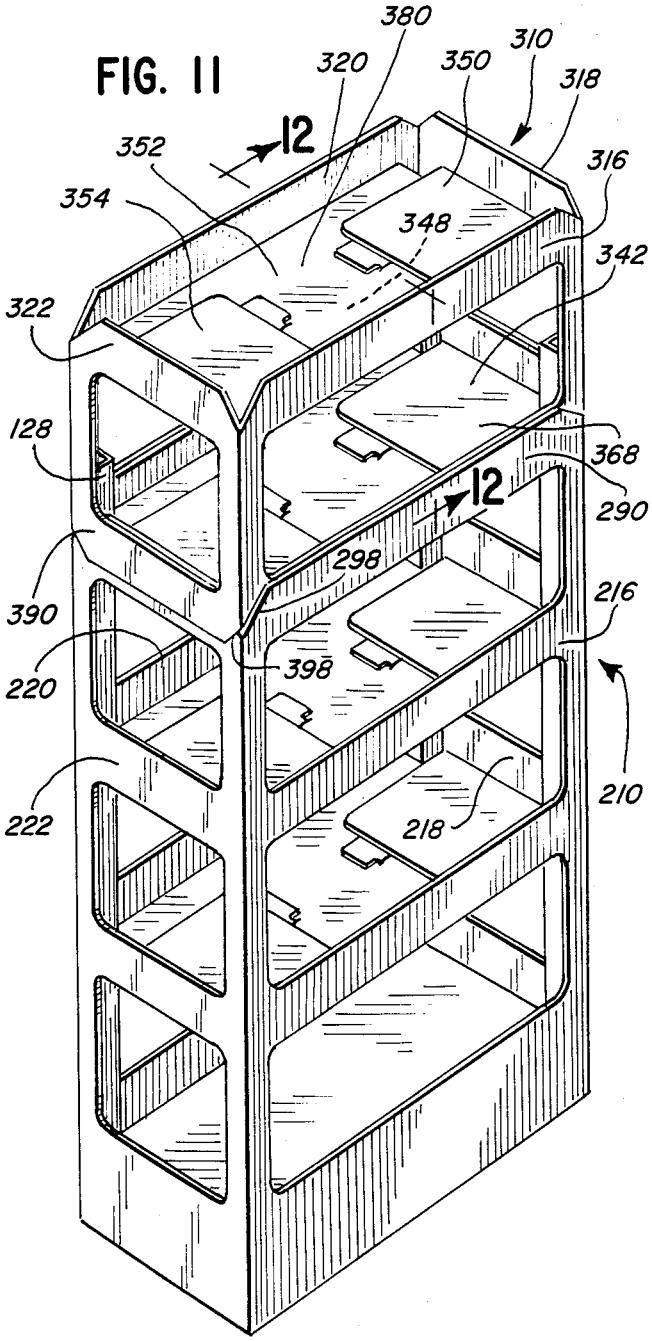
FIG. 11 is a perspective view of a single shelf module stacked in overlying relationship with the module of FIG. 10.
Figure 12:
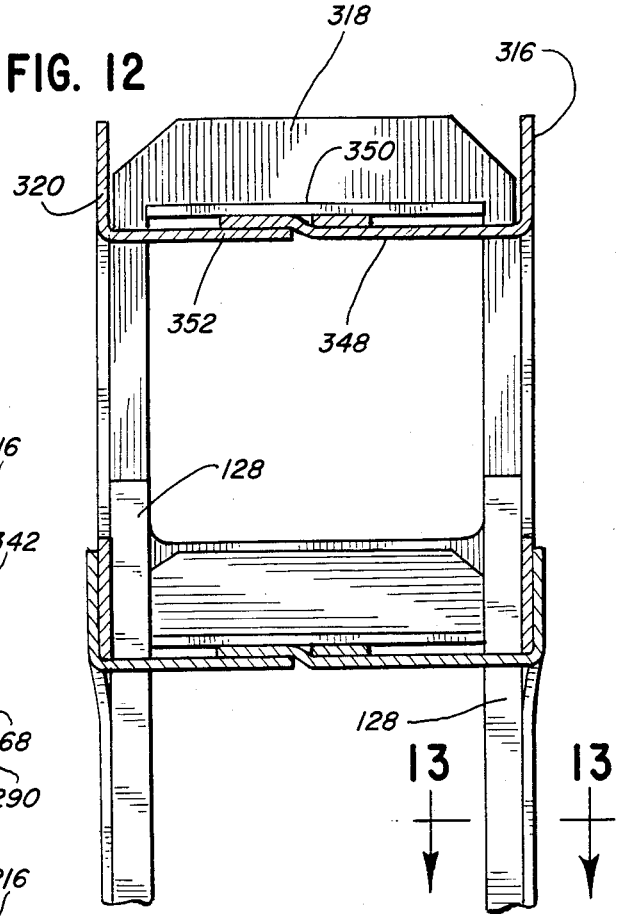
FIG. 12 is an enlarged, fragmentary sectional view of the stacked modules along line 12—12 of FIG. 11.
Figure 13:
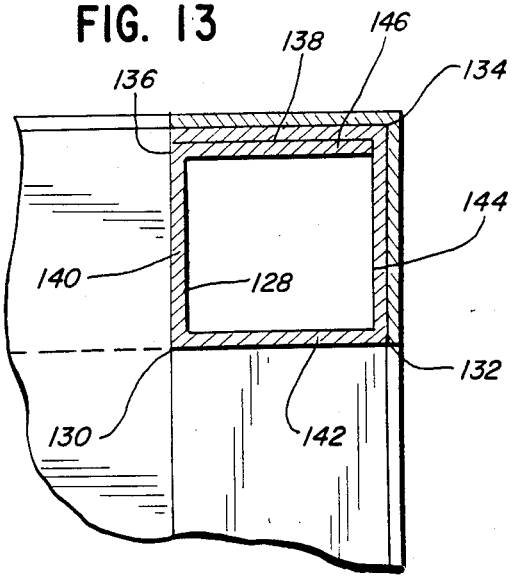
FIG. 13 is an enlarged, fragmentary sectional view of the pillar in relationship to the stacked modules along line 13—13 of FIG. 12.

FIGS. 11 and 12 demonstrate the use of the pillars in assembling the display module 210 with a single shelf display module 310. Any combination of single and/or multiple shelf modules is within the scope of the invention. The display module 310 is formed substantially as the multi-shelved module 210. The module 310 has panels 316, 318, 320, 322 connected foldably end to end with each other to cooperatively encircle a storage space 342. Flap pairs 348, 352 and 350, 354 cooperate in similar fashion to the prior embodiment and maintain the squared configuration of the panels. At the bottom of the panels 316, 318, 320, 322 is a free edge region 390 which telescopingly engages an upper free edge region 290 of the underlying module 210. The bottom edge region 390 of panels 316 and 320 bears on the upper shelf 268 of the module 210 and resides between the upper edge region 290 of panels 216, 220. The upper edge region 290 of the panels 218, 222 resides between the bottom edge region 290 of the panels 318, 322 of the module 310. The result is that the panels of the cooperating module pair are in effect woven with the panels of each module alternating between inside and outside positions. Cutouts 298, 398 are provided in the modules 210 and 310 respectively at the corners thereof to prevent interference as the stacked modules are mated.

The pillars 128 are extended through the cooperating apertures 148 of each shelf of the underlying module 210. The pillar length is such that they abut the surface supporting the module and extend several inches above the upper shelf 268 of the module 210. The pillars are inserted in the module 210 before the upper module 310 is stacked thereupon. The pillars fit closely within the corner of the overlying module 310. The pillars resist the tendency of the modules to distort and move laterally relative to each other as occurs for example when one withdraws articles from the uppermost shelf 380 of the upper module 310.

It should be understood that the foregoing description is made for purposes of demonstrating the structure and operation of the invention, with no unnecessary limitations to be understood therefrom.

I claim:

1. A collapsible display device comprising:

a wall blank having substantially flat wall panels connected end to end foldably relative to each other to define a continuous wall structure, said wall blank collapsible to a flattened state for storage and transportation and convertible to an expanded display state in which pairs of opposed, facing wall panels cooperatively bound a storage space;

first and second substantially flat flaps associated with each of the wall panels of one said wall panel pair;

means attaching each of the first and second flaps associated with each of the wall panels of the one wall panel pair foldably relative to its respective wall panel; and means interconnecting the first and second flaps on one of the wall panels of the one wall panel pair with the first and second flaps on the other of the wall panels of the one wall panel pair so that the first and second flaps of the one wall panel pair are situated in overlying facial engagement with one another and define first and second spaced shelves within the storage space for placement of articles to be displayed.

2. The collapsible display according to claim 1 wherein each of the first and second flaps associated with each of the wall panels of the one wall panel pair is struck directly from its associated wall panel and integrally, foldably attached thereto.

3. The collapsible display according to claim 1 wherein said first flap on one of the wall panels of the one wall panel pair has a tab and the first flap on the other of the wall panels of the one wall panel pair has a slot into which the tab can be extended to interconnect the first flaps.

4. The collapsible display according to claim 1 wherein a bearing flap is integrally, foldably associated with at least one of the panels of the other wall panel pair, said bearing flap facially overlying one of the shelves to maintain the flaps on the one shelf interconnected and cause a distribution of weight of displayed articles over the one shelf to prevent deformation thereof.

5. The collapsible display according to claim 1 in combination with a bottom shelf blank, said bottom shelf blank fitting within said storage space adjacent a bottom region of the display device and providing an additional shelf for display articles.

6. The collapsible display according to claim 3 wherein said tab has a leading free edge and a shoulder facing away from the free edge and said shoulder interferes with the first flap with the slot with the tab extended into the slot to prevent said first flaps from disengaging.

7. A collapsible display module comprising:

a wall blank having substantially flat wall panels connected end to end foldably relative to each other to define a continuous wall structure, said wall blank collapsible to a flattened state for storage and transportation and convertible to an expanded display state in which pairs of opposed, facing wall panels cooperatively bound a storage space;

at least one flap associated with each of the wall panels of one said wall panel pair;

means attaching each said flap foldably relative to its respective wall panel;

means interconnecting said flaps so that said flaps cooperatively define a shelf for placement of articles to be displayed in the storage space; and means associated with the wall blank for removably accepting a reinforcing pillar with the wall blank in its display state and the flaps interconnected, whereby, the modules can be used selectively with and without the pillar, said pillar serving to rigidify the module.

8. The collapsible display according to claim 7 in combination with an elongate pillar wherein said means associated with the wall blank comprise an aperture in the shelf for closely slidably accepting the pillar, said pillar being extendable through apertures in the shelves on adjacent stacked modules.

9. The collapsible display according to claim 8 wherein said module has an upper edge region and a lower edge region and means are provided for telescopingly engaging the upper edge region of an underlying module with the lower edge region of an overlying module and cooperate with the pillar to establish firm connection between stacked modules.

10. The collapsible display according to claim 8 wherein said pillar is hollow and defined by a piece of formed cardboard.

11. The collapsible display according to claim 8 wherein said wall panels each define right angle corners with an adjacent panel, said pillar has at least one square corner and the aperture in the shelf is located in the shelf so that the corner of the pillar seats closely in one of the corners of the module.

12. The collapsible display according to claim 7 in combination with an elongate pillar having a length greater than the height of the wall blank in its display state, whereby with the pillar in place in a first module, a portion of the pillar projects above the first module and can be connected to a second module similar to the first module that is stacked on the first module to rigidify a display consisting of both the first and second modules.

* * * * *